US005345726A

United States Patent [19]

Gach

[11] Patent Number: 5,345,726

[45] Date of Patent: Sep. 13, 1994

[54] GRINDING BIT APPARATUS

[76] Inventor: Paul Gach, 15487 Orchard Ridge Dr., Clinton Township, Macomb County, Mich. 48038

[21] Appl. No.: 109,647

[22] Filed: Aug. 20, 1993

Related U.S. Application Data

[63] Continuation of Ser. No. 913,582, Jul. 14, 1992, abandoned.

[51] Int. Cl.[5] ..... B24B 9/10

[52] U.S. Cl. ..... 451/450; 451/177

[58] Field of Search ..... 51/267, 72 R, 98 R, 51/102, 266, 272, 322

[56] References Cited

U.S. PATENT DOCUMENTS

| | | | |
|---|---|---|---|
| 387,555 | 8/1888 | Cummings | 51/267 |
| 614,138 | 11/1898 | Sims . | |
| 1,827,688 | 10/1931 | Ley | 51/56 R |
| 2,110,441 | 3/1938 | Kasch | 51/267 |
| 2,343,556 | 3/1944 | Jacobsen | 51/98 R |
| 2,377,271 | 5/1945 | Schumann | 464/17 |
| 2,457,283 | 12/1948 | Slater | 51/125 |
| 2,489,437 | 11/1949 | Sandoz | 51/267 |
| 2,735,236 | 2/1956 | Townshend | 51/102 |
| 2,826,019 | 3/1958 | Garrison | 51/267 |
| 3,153,885 | 10/1964 | Keller et al. | 51/267 |
| 3,459,379 | 8/1969 | Brown | 241/38 |
| 3,483,858 | 12/1969 | Jansen | 125/13.01 |
| 3,775,908 | 12/1973 | Meckler et al. | 51/72 R |
| 4,446,657 | 5/1984 | Asaeda et al. | 51/206 R |
| 4,516,357 | 5/1985 | Gach | 51/98 R |
| 4,558,538 | 12/1985 | Green | 51/72 R |
| 5,123,215 | 6/1992 | Acheson | 51/168 |

FOREIGN PATENT DOCUMENTS

| | | | |
|---|---|---|---|
| 0271674 | 11/1987 | Japan | 51/267 |

*Primary Examiner*—Bruce M. Kisliuk
*Assistant Examiner*—Eileen P. Morgan
*Attorney, Agent, or Firm*—Peter D. Keefe

[57] ABSTRACT

A grinding bit apparatus used in conjunction with a grinding machine. A water pump in the form of a cylindrically shaped member having a helical groove on the surface thereof is mounted on the drive shaft of the grinding machine, a lower end portion thereof being located in a water reservoir. A grinding bit is mounted to the drive shaft above the water pump and is passively connected with the water pump so as to rotate with the drive shaft. One or more washers are placed between the water pump and the grinding bit so as to selectively vary the location of the working surface of the grinding bit with respect to the work table. An annular collar openings is provided which depends from the work table to surround the water pump and any portion of the grinding bit below the work surface. In another aspect of the grinding bit apparatus, other diameter grinding bits may be passively mounted to the drive shaft above the water pump, including a small diameter grinding bit suitable for performing both grinding and drilling operations. A modified annular collar is provided which is elongated and has connected therewith an auxiliary work table at the height of the small diameter grinding bit, and has further connected therewith an inner annular flange so that the top end opening thereof is located suitably near the grinding bit. A pair of internal tabs attached to the inner annular flange serve to direct rising and rotating coolant water from the water pump to the working surface of the small diameter grinding wheel.

20 Claims, 2 Drawing Sheets

GRINDING BIT APPARATUS

CROSS-REFERENCE TO RELATED APPLICATIONS

The present application is a continuation of application Ser. No. 07/913,582, filed Jul. 14, 1992, now abandoned.

BACKGROUND OF THE INVENTION

1. Field of the Invention

The present invention relates to grinding bit apparatus used in connection with grinding machines, particularly grinding machines of the class used for performing operations on stained glass panes. The present invention more particularly relates to an improved grinding bit apparatus having improved operational flexibility and improved operational performance.

2. Description of the Prior Art

Grinding machines generally incorporate a frame supporting a work holder or work table, a prime mover connected with the frame, a drive shaft connected with the prime mover, and a grinding bit connected with the drive shaft for performing a grinding operation on a workpiece. Variations on this scheme are plentiful, and the grinding bit may have various configurations ranging from an elongate cylindrical shape mounted axially with respect to the drive shaft to a wheel shape mounted horizontally with respect to the drive shaft.

In many instances, the heat generated from the grinding operation is excessive to the point that provision must be made for its removal and/or control. In these instances, air or water is fed to the grinding bit in order to serve as a coolant. Also, certain operations may benefit directly from the introduction of wash water on the grinding bit as an aid to the grinding process being performed on the workpiece.

There are a number of examples of grinding machines employing grinding bits which are cooled by water. U.S. Pat. No. 1,827,688 to Ley, dated Oct. 13, 1931, discloses a grinding machine utilizing a water reservoir beneath the bit and a screw-like formation located in the reservoir for spraying water up onto the grinding bit. U.S. Pat. No. 2,110,441 to Kasch, dated Mar. 8, 1938, discloses a grinding machine utilizing a grinding bit which is supplied with water coolant via operation of a propeller-shaped member located in the water reservoir beneath the grinding bit. U.S. Pat. No. 2,457,283 to Slatter, dated Dec. 28, 1948, discloses a grinding machine having a cup-shaped grinding bit cooled by water from a reservoir that is driven up a duct therein, and further having a tool holder in the form of an adjustable head supported on a standard adjacent the grinding bit. Finally, U.S. Pat. No. 2,489,437 to Sandoz, dated Nov. 29, 1949, discloses a grinding machine having a spindle carrying a grinding bit in which water is used to cool the spindles and cool the grinding bit as it makes its way flowably thereto.

Grinding machines used to shape glass panes, such as glass panes used in the making of stained glass works, are provided with a vertical drive shaft to which is connected a cylindrically shaped bit, a work table for holding the glass pane perpendicularly with respect to the bit, and water transfer means to serve as a coolant and particle wash during the grinding operation. In this regard, the artisan's hand moves the glass pane on the work table into selective engagement with the grinding bit so as to achieve a desired finished product.

There are various structures known in the prior art to provide water to the bit during a grinding operation. One structure utilizes a sponge which partly rests in the water reservoir and makes contact with the grinding bit. While this structure is simple and inexpensive, it is subject to excessive wear may be accidentally knocked out of position, may not provide an adequate water supply to the grinding bit, and because the sponge accumulates particles during grinding, periodic cleaning thereof is required.

One grinding machine which provides a mechanically induced supply of water to the grinding bit is disclosed in U.S. Pat. No. 4,516,357 to Gach, dated May 14, 1985. In this grinding machine, coolant water is supplied to the grinding bit by an impeller mounted to the drive shaft. A prime mover in the form of an electric motor drives the drive shaft from a location below the water reservoir, the drive shaft protruding vertically up from the reservoir. Below the grinding bit, and located within the reservoir, is an impeller rotatable with the grinding bit. Surrounding the impeller and the lower portion of the grinding bit is an annular collar that depends from the underside of a work table. In operation, when the drive shaft rotates, the impeller drives water from the reservoir up toward the working surface of the grinding bit, and the annular collar helps to contain the water driven by the impeller. At the top of the annular collar, whereat is provided a grinding bit opening in the work table, a frustoconical bevel (oriented upwardly toward the grinding bit) directs the coolant onto the working surface of the grinding bit.

The aforesaid device disclosed in U.S. Pat. No. 4,516,357 has the advantage of being able to supply water from a reservoir for cooling and washing of the grinding bit without the need for a sponge or complicated pumping and piping that may be otherwise present in industrial grinding machines. However, certain disadvantages still pertain. For example, the various impellers disclosed therein all have structures which serve to splash water toward the grinding bit by a general agitation of the water in the reservoir. This is inefficient and results in a poor water transfer rate compared with the amount of agitation that is produced in the reservoir. Further, there is no provision for axial adjustment of the work surface of the grinding bit relative to the work table so that wear-out of the grinding bit can be extended across the entire grinding surface of the grinding bit. Finally, there is no provision for replacement of the grinding bit with other sized grinding bits, in which certain of these grinding bits could perform other operations, such as drilling.

Importantly, too, prior art impellers, such as that disclosed hereinabove, will not raise water from the reservoir to a height above the work table. This limits the location of the grinding bit to a height only at the work table, thereby preventing the use of small diameter grinding hits which must, because of their small diameter, be mounted at the end of the drive shaft at a height above the work table.

Accordingly, what is needed is a grinding machine, particularly a grinding machine adapted for use with pane glass, which has none of the disadvantages of U.S. Pat. No. 4,516,357 discussed hereinabove.

In the prior art there are several examples of grinding machines which disclose structures of interest. For instance, U.S. Pat. No. 3,775,908 to Meckler et al, dated Dec. 4, 1973, discloses a grinding machine particularly adapted for spectacles glass grinding having a fine grinding bit and a rough grinding bit arranged together on a bushing which is axially displaceable on the drive shaft of the machine. And further for instance, U.S. Pat. 4,446,657 to Asaeda et al, dated May 8, 1984, discloses a grinding bit having a sealing layer between the grinding portion thereof and the support portion thereof so that coolant water cannot penetrate into the support portion. And still further for instance, U.S. Pat. No. 4,558,538 to Green, dated Dec. 17, 1985, discloses a sander having a bit in the form of a sleeve covered by sandpaper which is axially supported at both ends by an arbor; the sleeve is axially positionable along the arbor so as to provide fresh bit surface as needed for sanding operations. Yet none of these offers solutions adoptable to provide a grinder machine of the type needed.

SUMMARY OF THE INVENTION

The present invention is a grinding hit apparatus for use in connection with a grinding machine, particularly a grinding machine adapted for use with stained glass pane forming operations, in which a supply of water from a reservoir, used for cooling and washing of the grinding hit, is provided in a controlled, efficient manner, axial adjustment of the working surface of the grinding hit is provided thereof, and replacement of the grinding bit with other sized grinding bits is provided, in which certain of these grinding bits grinding bits is provided, in which certain of these grinding bits could perform other operations, such as drilling.

The grinding bit apparatus according to the present invention is preferably used in conjunction with a grinder machine of the class disclosed in U.S. Pat. No. 4,516,357. A water pump in the form of a cylindrically shaped member having a helical groove on the surface thereof is mounted on the drive shaft, a lower end portion thereof being located in the water reservoir. A grinding bit is mounted to the drive shaft above the water pump and is connected thereto so as to rotate with the drive shaft. One or more washers are placed between the water pump and the grinding bit so as to selectively vary the location of the working surface of the grinding bit with respect to the work table. An annular collar having top and bottom end openings is provided which interfaces with the work table and depends therefrom into the reservoir of water to surround the water pump and any portion of the grinding bit below the working surface thereof. In operation, rotation of the drive shaft results in the water pump acting as an Archimedes screw to pump water upwardly from the reservoir to the grinding bit. In this regard, an annular bevel at the top end opening of the annular collar serves to retain a plentiful supply of water adjacent the working surface of the grinding bit. As the working surface of the grinding bit becomes worn-out, one or more washers may be added to change the axial position of the grinding bit with respect to the drive shaft so as to present a fresh working surface adjacent the plane of the work table.

In another aspect of the grinding bit apparatus according to the present invention, various other diameter grinding bits may be mounted to the drive shaft above the water pump, including a small diameter grinding bit suitable for performing both grinding and drilling operations on glass panes, the small diameter grinding wheel sitting on a mounting member which is, itself, mounted on the drive shaft. A modified annular collar is provided which is elongated and has connected therewith an auxiliary work table which provides a new work table at the height of the small diameter grinding bit, and having an inner annular flange so that the top end opening thereof is located suitably near the grinding bit. A pair of internal tabs attached to the inner annular flange serve to direct rising and rotating coolant water from the water pump to the working surface of the small diameter grinding bit. In operation, as wear on the working surface of the small diameter grinding bit occurs, washers may be placed selectively between the water pump and the mounting member so as to a provide fresh working surface.

Accordingly, it is an object of the present invention to provide a grinding bit apparatus for a grinding machine which provides for coolant to the grinding bit in a controlled, efficient and plentiful manner, even to heights considerably above the coolant reservoir.

It is an additional object of the present invention to provide a grinding bit apparatus for a grinding machine which provides for selective axial adjustment of the grinding bit with respect to the drive shaft so that all the grinding surface of the grinding bit may be, over time, used as a working surface.

It is another object of the present invention to provide a grinding bit apparatus for a grinding machine which provides for changing of grinding bits of various diameters.

It is a further object of the present invention to provide a grinding bit apparatus for a grinding machine which provides for a plentiful amount water at the working surface of the grinding bit even when a different diameter grinding bit has been installed.

It is yet another object of the present invention to provide a grinding bit apparatus for a grinding machine which provides for a simple and easy, yet effective passive mechanism for permitting grinding bit substitution without need for turning setscrews or other related fastener device.

These, and additional objects, advantages, features and benefits of the present invention will become apparent from the following specification.

DETAILED DESCRIPTION OF THE PREFERRED EMBODIMENT

Figure 1:
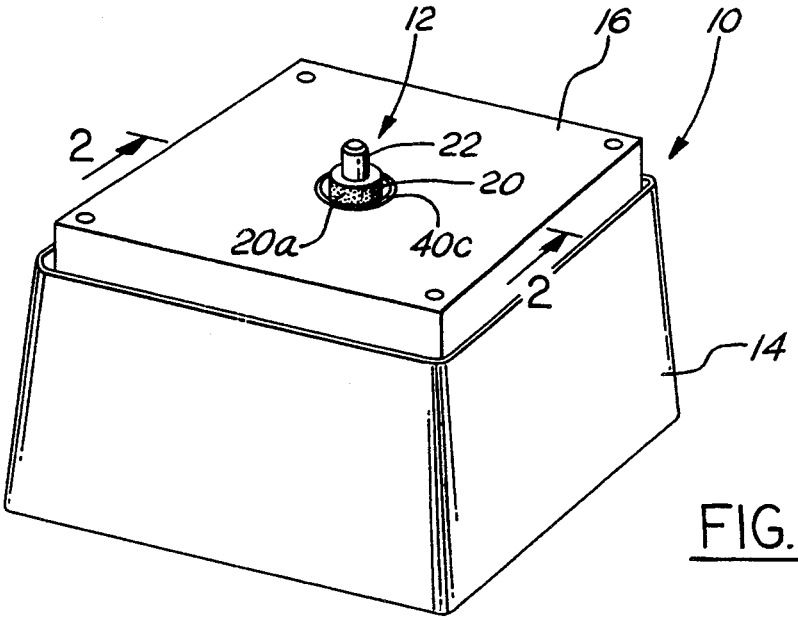
FIG. 1 is a perspective view of a grinding machine equipped with the grinding hit apparatus according to the present invention.

Referring now to FIG. 1, a grinding machine 10 is shown having an incorporated grinding bit apparatus 12 according to the present invention. As can be discerned from FIG. 1, a base 14 supports a work table 16. A grinding bit 20 is mounted upon a drive shaft 22 so as to extend at least in part above the work table 16. In operation, a user lays a piece of glass pane on the work table 16, and, with the drive shaft 22 rotating, engages the piece of glass pane selectively with respect to the grinding bit 20. In this regard, that portion of the grinding surface of the grinding bit which is adjacent the work table 16 sufficient to engage the glass pane is the working surface 20*a* of the grinding hit.

Figure 2:
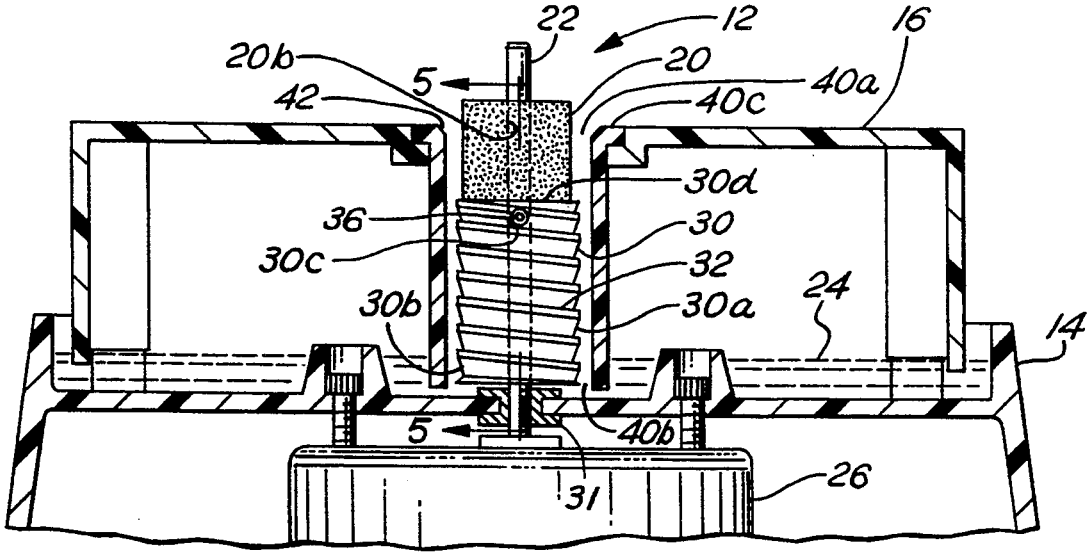
FIG. 2 is a partly sectional side view of the grinding machine with the grinding bit apparatus according to the present invention, shown along lines 2—2 in FIG. 1, in which no washer between the water pump and the grinding bit is used.

As can be discerned with reference now being directed to FIG. 2, it will be noted that the grinding machine 10 includes a reservoir 24 of water (other liquids may be substituted, of course, with water being the preferred reservoir liquid). A prime mover 26 in the form of an electric motor is located beneath the reservoir 24 and the drive shaft 22 thereof extends vertically upward therefrom through the reservoir and above the work table 16. A seal 31 or alternatively an annular retaining wall member (not shown) provides a leak tight relationship between the prime mover 26 and the reservoir 24.

In order for water from the reservoir 24 to be lifted to the working surface 20*a* of the grinding bit 20, a water pump 30 is provided. The water pump 30 is of a cylindrical shape having a length preferably on the order of twice the diameter thereof. The cylindrical sidewall 30*a* of the water pump 30 carries an exterior helical groove 32. The water pump 30 is axially mounted with respect to the drive shaft 22 so that its lower end portion 30*b* is located in contact with the water of the reservoir, and axial pump bore 30*c* therein being provided for this purpose. A setscrew 36 seats in a threaded hole in the cylindrical sidewall 30*a* and serves to secure the water pump 30 engageably with respect to the drive shaft 22 without the lower end portion 30*b* thereof touching any non-rotating components of the grinding machine 10. The exterior helical groove 32 is preferably coarsely dimensioned. By way of example only, and not indicative of a requirement, the external helical groove 32 may make approximately six to ten revolutions of the cylindrical sidewall 30*a*, where the water pump is about one inch in length from one end to the other. The coarseness of the exterior helical groove 32, which depends upon its pitch, width and depth, is predetermined to provide an interface with the water of the reservoir 24 such as to provide a plentiful amount of water rising up the exterior helical groove as the cylindrical sidewall 30*a* rotates, loosely along the principle of an Archimedes' screw.

Figure 5:
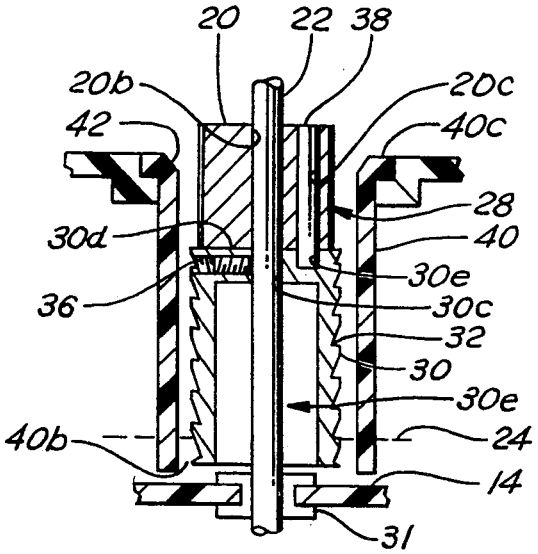
FIG. 5 is a partly sectional detail side view of the grinding bit apparatus according to the present invention seen along lines 5—5 in FIG. 2, shown with no washer located between the water pump and the grinding bit, and particularly showing a preferred rotary transmission mechanism therebetween.
Figure 10:
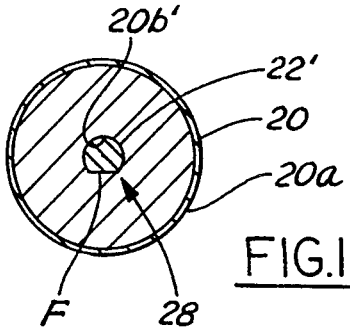
FIG. 10 is a sectional top plan view of an alternative preferred rotary transmission mechanism between the drive shaft and the grinding bit.
Figure 11:
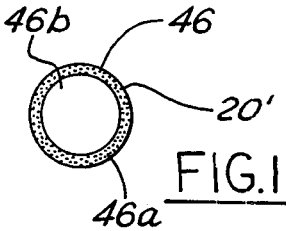
FIG. 11 is a top plan view of a tip of a grinding bit member according to the present invention, seen along lines 11—11 in FIG. 8.
Figure 9:
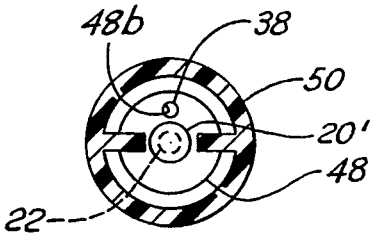
FIG. 9 is a sectional view through lines 9—9 in FIG. 8.

The grinding bit 20 is mounted to the drive shaft 22 adjacent the upper end 30*d* of the water pump 30 via an axial bit bore 20*b*. Because it is desired that grinding bits be easily interchangeable, a setscrew engagement with the drive shaft 22 is not preferred. Rather, it is preferred to provide to drive the grinding bit by use of a passive drive mechanism 28 between the drive shaft 22 and the grinding bit 20 which requires essentially no affirmative action from the user other than simply placing the grinding bit onto the drive shaft. One preferred passive drive mechanism 28 can be seen in FIG. 5. An axially offset bit bore 20*c* is provided in the grinding bit 20 which is alignable with a blind pump bore 30*e* at the upper end 30*d* of the water pump 30. A pin 38 passes through the axially offset bit bore 20*c* and rests into the blind pump bore 30*e*. The couple formed by the drive shaft 22 and the pin 38 cause the grinding bit 20 to rotate with the water pump 30 (and, consequently, the drive shaft) without need of affirmative action (such as tightening a setscrew) on the part of the user to secure drivable engagement of the grinding bit to the drive shaft. FIG. 10 shows another example of a passive drive mechanism 28 which obviates the axially offset bit bore 20*c* blind pump bore 30*e* and pin 38. A modified drive shaft 22′ is provided with other than a circular cross-section and a modified axial bit bore 20*b*′ has a cross-section which is reciprocally shaped to fit thereon. As shown in FIG. 10, any flat or other non-circular portion F serving as an abutment for providing rotative engagement of the grinding bit with the drive shaft will suffice.

An annular collar 40 having a top end opening 40*a* located at the work table 16 and a bottom end opening 40*b* located into the water of the reservoir 24 is provided, encircling the water pump 30 and any portion of the grinding bit 20 located below the work table 16. The work table 16 is provided with an annular recess 16*a* which supportably interfaces with an outer annular rim 40*c* that is integrally connected with the annular collar 40 at the top end opening 40*a* thereof. Accordingly, the annular collar 40 is easily removed and replaced with respect to the work table 16. Alternatively, the annular collar may be otherwise connected to the work table, as for example by an integral or adhesive connection. The annular collar 40 is spaced from the water pump a predetermined distance so that it will serve as a confining aid to water movement up the external helical groove 32. At the top end opening 40*a* of the annular collar 40 is provided a bevel 42 which inclines upwardly away from the grinding bit 20. The bevel 42 serves as a water accumulation location adjacent the grinding bit 20 so as to provide a plentiful supply of water at the working surface 20*a*.

Figure 3:
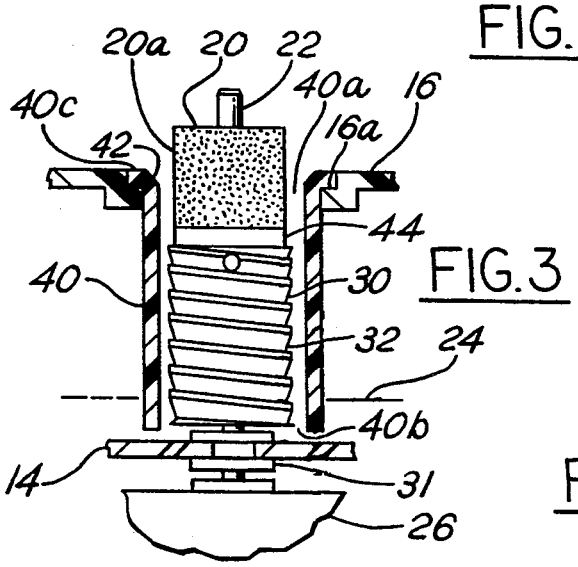
FIG. 3 is a partly sectional detail side view of the grinding bit apparatus according to the present invention mounted to the grinding machine depicted in FIG. 1, shown with one washer located between the water pump and the grinding bit.
Figure 4:
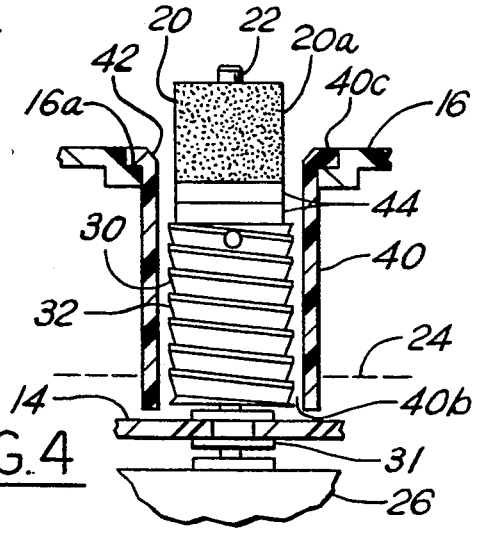
FIG. 4 is a partly sectional detail side view of the grinding bit apparatus according to the present invention mounted to the grinding machine depicted in FIG. 1, now shown with two washers located between the water pump and the grinding bit.
Figure 6:
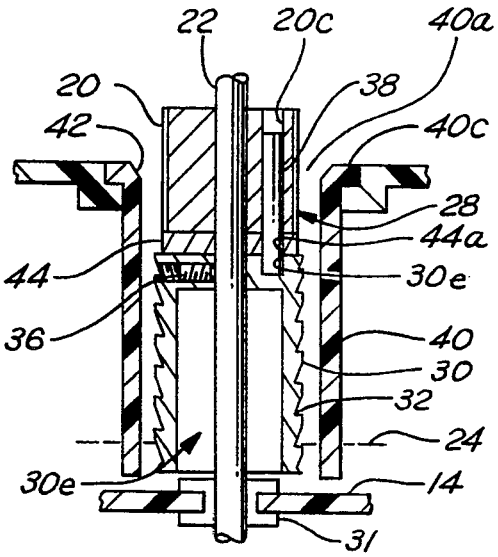
FIG. 6 is a partly sectional detail side view of the grinding bit apparatus according to the present invention as seen also along lines 5—5 in FIG. 2, shown now with one washer located between the water pump and the grinding bit, and particularly showing the preferred rotary transmission mechanism therebetween.

Over time, the working surface 20*a* of the grinding bit 20 will become worn. New working surface 20*a* is easily provided as follows. Since the grinding bit 20 is symmetrical from end to end and passively connected with the drive shaft 22, a new working surface can be gained by removing the grinding bit, inverting it, then placing it back onto the drive shaft 22 (with the pin 38 preferably staying in the axially offset bit bore 20*c* during this process). Additional new working surface may be achieved by the placement of one or more washers 44 between the grinding bit 20 and the upper end 30*d* of the water pump 30. Preferably, the washers 44 have a diameter at least on the order of the thickness of the glass panes being worked on so that a washer can lift the grinding bit 20 to a position where an all new working surface is presented for further glass pane grinding operations. In order that the pin 38 may pass from the axially offset bit bore 20*c* of the grinding bit 20 to the blind pump bore 30*e* on the water pump 30, the washers 44 are provided with a hole 44*a* alignable with both the aforesaid bores 20*c*, 30*e*, as shown in FIG. 6. The washers 44 may have various thicknesses. FIG. 3 shows a grinding bit apparatus 10 having one washer 44 installed, and FIG. 4 shows two washers 44 installed.

Figure 7:
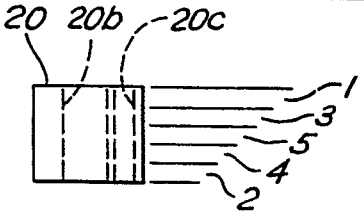
FIG. 7 is a schematic side view of a grinding bit according to the present invention in which various working surfaces are provided by selective usage of one or more washers between the water pump and the grinding bit.

In operation, as the drive shaft turns, the water pump and grinding bit turn. The water pump pumps water via rotation of the external helical groove aided by water confinement proximate thereto by operation of the annular collar so as to cause water to travel up the helical groove and thereby, in combination with the annular collar, reach the working surface of the grinding bit, with water accumulating at the bevel at the top end opening of the annular collar. When the working surface of the grinding bit has dulled, new working surface may be obtained by inverting the grinding bit and/or inserting washers between the grinding bit and the water pump. As exemplified in FIG. 7 a number of working surfaces encompassing the entire grinding bit grinding surface is possible as follows: working surface 1 is first used until it becomes dull, then the grinding bit is inverted to reveal grinding surface 2. When working surface 2 becomes dull, the grinding bit is inverted and a first washer is inserted between the grinding bit and the water pump to provide working surface number 3. When working surface number 3 becomes dull, the grinding bit is inverted to reveal working surface 4. When working surface 4 becomes dull, a second washer is added to the first washer between the grinding bit and the water pump to provide working surface number 5. When working surface number 5 becomes dull, it is time to replace the grinding bit. Thus, great economy is afforded, since the entire grinding surface of the grinding bit is easily accessed in a sequential manner during usage.

In another aspect of the grinding bit apparatus 12' according to the present invention, various other diameter grinding bits may be mounted to the drive shaft 22. In this regard, a grinding bit member 20' (preferably being considerably smaller in diameter than that of the aforesaid grinding bit 20) is structured for performing grinding and preferably also drilling operations on workpieces, such as for example stained glass panes. In this respect, a drilling tip 46 of the grinding bit member 20' is preferably provided. The tip 46 has a suitable tip surface 46*a* for forming a hole in a workpiece, such as a stained glass pane, and preferably the tip surface is annular, forming an axial recess 46*b* thereinside. The grinding bit member 20' is fastened to a mounting member 48. The mounting member 48 is preferably mounted with respect to the drive shaft 22 so as to be driven by the passive drive mechanism 24 discussed hereinabove. In this regard, for example, a blind axial mounting bore 48*a* receives the drive shaft 22, while a blind axially offset mounting bore 48*b* receives the pin 38. Alternatively, another passive drive mechanism 28 may be used, such as that depicted in FIG. 10.

Figure 8:
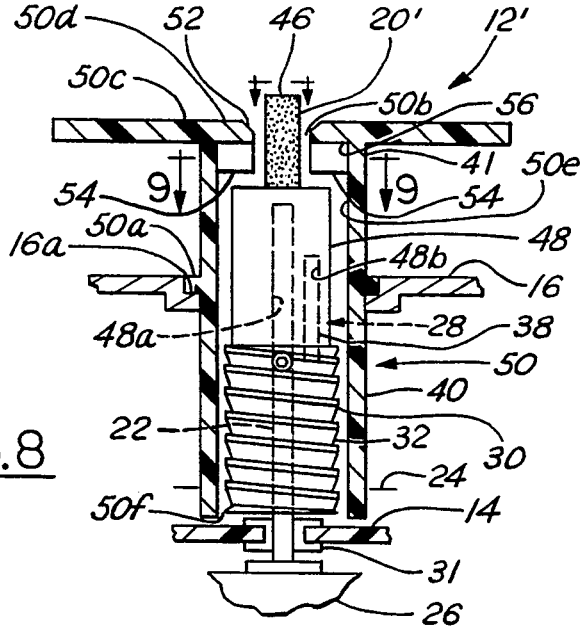
FIG. 8 is a partly sectional detail side view of another aspect of the grinding bit apparatus according to the present invention mounted to the grinding machine depicted in FIG. 1, shown with a small diameter grinding bit and its attendant modified annular collar.

A modified annular collar 50 is provided which is elongated so as to extend above the work table 16. In this regard, the annular collar 40 forms a lower portion thereof and an annular extension collar 41 forms an upper portion thereof. The annular collar 40 and the annular extension collar 41 which collectively form the modified annular collar 50 may be mutually releasably connected by any suitable interconnection structure or may be mutually integrally connected, FIG. 8 showing an integral connection therebetween. An outer annular flange 50*a* supportably interfaces with the annular recess 16 of the work table 16 so that the lower end opening 50*f* is situated in the water of the reservoir 24. Alternatively, the modified annular collar may be otherwise connected to the work table, as for example as by an integral or adhesive connection. The modified annular collar 50 has connected therewith at the top end opening 50*b* thereof an auxiliary table member 50*c* which provides a new work table at the height of the small diameter grinding bit 20'. In order that the top end opening 50*b* of the modified annular collar 50 is sized to correspond with the smaller diameter of the small diameter grinding bit 20', an inner annular flange 50*d* is connected thereto so that the top end opening thereof is located suitably near the small diameter grinding bit. A bevel 52 is provided on the inside radius of the inner annular flange 50*d*, which serves the same purpose as that of the bevel 42 discussed hereinabove. A pair of tabs 54 are attached to the modified annular collar at the inner annular flange 50*d*, spanning the corner 56 formed therebetween, the tabs being mutually 180 degrees apart. While two tabs 54 are preferred, it is possible to use other than two tabs 54. The tabs 54 serve to disturb the upward spiraling flow of water (from the water pump) rising upwardly adjacent the inside surface 50*e* of the modified annular collar 50 so as to cause the water to diverge therefrom toward the grinding bit member 20'.

In operation of this aspect of the grinding bit apparatus according to the present invention, as wear on the working surface of the grinding bit member occurs, one or more washers 44 may be placed selectively between the water pump 30 and the mounting member 48 so as to a provide fresh working surface in the manner generally disclosed hereinabove.

To those skilled in the art to which this invention appertains, the above described preferred embodiment may be subject to change or modification. For instance, the water pump 30 may be provided with an internal hollow 30*e* at and near its lower end 40*b* for accommodating an annular retaining wall member referenced hereinabove. Such change or modification can be carried out without departing from the scope of the invention, which is intended to be limited only by the scope of the appended claims.

What is claimed is:

1. A grinding bit apparatus for use with a grinding machine, the grinding machine having a base, a prime mover connected with the base, a drive shaft connected with the prime mover, a reservoir of a liquid situated upon the base above the prime mover, and a work table connected with the base and located above the reservoir so that the drive shaft passes through the reservoir and extends above the work table, said grinding bit apparatus comprising:

a pump having an upper end and an opposite lower end, said pump further having a cylindrical sidewall extending from said upper end to said lower end, said pump being structured for being driveably mounted on the drive shaft so as to rotate with the drive shaft and so that said lower end of said pump is located in the liquid, said cylindrical sidewall being provided with external helical groove means extending from said lower end to said upper end of said pump for engaging the liquid;

a grinding bit structured for being removably mounted to the drive shaft adjacent said upper end of said pump;

drive means for transmitting rotation between the drive shaft and said grinding bit; and annular collar means spaced from said pump and stationarily located relative to the grinding machine for providing confinement of the liquid when said pump is rotated by the drive shaft, said annular collar means having an upper end and an opposite lower end, said upper end of said annular collar means extending to the work table, said lower end of said annular collar means extending into the liquid;

wherein when the drive shaft rotates said pump said external helical groove means engages the liquid so as to pump the liquid, in combination with liquid confinement provided by said annular collar means, to said working surface of said grinding bit.

2. The grinding bit apparatus of claim 1, wherein said grinding bit has a first end and a second end, wherein further said grinding bit is symmetrically structured from said first end to said second end so that either said first end thereof or said second end thereof may be placed adjacent said pump, wherein further, said grinding bit has an exterior cylindrical surface which provides a working surface adjacent the work table for grinding of a workpiece, said grinding bit having an axial bit bore which provides removable mounting thereof to the drive shaft adjacent said upper end of said pump; wherein still further, said drive means comprises passive drive mechanism means for passively connecting said grinding bit to the drive shaft, wherein passively connecting is defined as driveably connecting said grinding bit to said drive shaft without use of a fastener.

3. The grinding bit apparatus of claim 2, wherein the drive shaft has a non-circular cross-section, said passive drive mechanism means comprising:

said axial bit bore being reciprocally shaped with respect to the non-circular cross-section of the drive shaft so that said grinding bit is driveably mounted with respect to the drive shaft.

4. The grinding bit apparatus of claim 2, further comprising at least one washer placed between said grinding bit and said pump for repositioning said grinding bit relative to said pump so as to provide a new working surface on said grinding bit adjacent the work table of the grinding machine.

5. The grinding bit apparatus of claim 4, wherein the work table is provided with an annular recess axially centered with respect to the drive shaft, said annular collar means comprising an outer annular rim structured which supportably interfaces with the annular recess of the work table, said annular collar means further having bevel means at said upper end thereof for providing an accumulation location for the liquid adjacent said grinding bit.

6. The grinding bit apparatus of claim 1, wherein said grinding bit comprises:

a grinding bit member having a first end and an opposite second end, said grinding bit member having an exterior cylindrical surface for grinding a workpiece; and a mounting member connected with one of said first and second ends of said grinding bit member, said mounting member having an axial mounting bore for providing removable mounting thereof to the drive shaft adjacent said upper end of said pump, said drive means interfacing with said mounting member for transmitting rotation from the drive shaft to said grinding bit member;

further wherein said annular collar means further comprises:

annular extension collar means for providing confinement of the liquid above the work table when said pump is rotated by the drive shaft, said annular extension collar means having a bottom end and a top end, said bottom end of said annular extension collar means connecting with said upper end of said annular collar means; and auxiliary work table member means connected with said top end of said annular extension collar for providing a work table adjacent said grinding bit member, a working surface of said exterior cylindrical surface of said grinding bit member being located adjacent said auxiliary work table member means.

7. The grinding bit apparatus of claim 6, wherein said top end of said annular extension collar means further comprises:

inner annular flange means for providing a top end opening of said annular extension collar means which is proximate said grinding bit member;

tab means connected with said inner flange means for causing the liquid pumped by said pump to diverge from said annular extension collar means toward said grinding bit member; and bevel means on said inner annular flange means for providing an accumulation location for the liquid adjacent said grinding bit member.

8. The grinding bit apparatus of claim 7, wherein said upper end of said annular collar means is integrally connected with said bottom end of said annular extension collar means.

9. The grinding bit apparatus of claim 8, wherein said drive means comprises passive drive mechanism means for passively connecting said grinding bit to the drive shaft, wherein passively connecting is defined as driveably connecting said grinding bit to said drive shaft without use of a fastener.

10. A grinding bit apparatus for use with a grinding machine, the grinding machine having a base, a prime mover connected with the base, a drive shaft connected with the prime mover, a reservoir of a liquid situated upon the base above the prime mover, and a work table connected with the base and located above the reservoir so that the drive shaft passes through the reservoir and extends above the work table, said grinding bit apparatus comprising:

pump means for pumping the liquid, said pump means being engageably mounted on the drive shaft so as to rotate with the drive shaft and so that at least a portion of said pump is located in the liquid, said pump means having an upper end;

a grinding bit having an exterior cylindrical surface which provides a working surface adjacent the work table for grinding of a workpiece, said grinding bit having a first end and a second end, said grinding bit having an axial bit bore which provides removable mounting thereof to the drive shaft adjacent said upper end of said pump, said grinding bit being symmetrically structured from said first end to said second end so that either said first end thereof or said second end thereof may be placed adjacent said pump;

passive drive mechanism means for passively connecting said grinding bit to the drive shaft so as to provide transmission of rotation between said grinding bit and the drive shaft, wherein passively connecting is defined as driveably connecting said grinding bit to said drive shaft without use of a fastener; and annular collar means for providing confinement of the liquid when said pump is rotated by the drive shaft, said annular collar means having an upper end and an opposite lower end, said upper end of said annular collar means being structured for being connected with the work table, said lower end of said annular collar means extending into the liquid;

wherein when the drive shaft rotates said pump engages the liquid so as to pump the liquid, in combination with liquid confinement provided by said annular collar means, to said working surface of said grinding bit.

11. The grinding bit apparatus of claim 10, wherein at least a portion of the drive shaft has a non-circular cross-section, said passive drive mechanism means comprising:

said axial bit bore being reciprocally shaped with respect to the non-circular cross-section of the drive shaft so that said grinding bit is driveably mounted to the non-circular cross-section of the drive shaft.

12. The grinding bit apparatus of claim 11, further comprising at least one washer placed between said grinding bit and said pump for repositioning said grinding bit relative to said pump so as to provide a new working surface on said grinding bit adjacent the work table of the grinding machine.

13. A grinding machine, comprising:

a base;

a prime mover connected with said base;

a drive shaft connected with said prime mover;

a reservoir of a liquid situated upon said base above said prime mover;

a work table connected with said base and located above said reservoir so that said drive shaft passes through said reservoir and extends above said work table; and grinding bit apparatus, comprising:

a pump having an upper end and an opposite lower end, said pump further having a cylindrical sidewall extending from said upper end to said lower end, said pump being structured for being driveably mounted on said drive shaft so as to rotate with said drive shaft and so that said lower end of said pump is located in said liquid, said cylindrical sidewall being provided with external helical groove means extending from said lower end to said upper end of said pump for engaging with said liquid;

a grinding bit structured for being removably mounted to said drive shaft adjacent said upper end of said pump;

drive means for transmitting rotation between said drive shaft and said grinding bit; and annular collar means spaced from said pump and stationarily located relative to said base for providing confinement of said liquid when said pump is rotated by said drive shaft, said annular collar means having an upper end and an opposite lower end, said upper end of said annular collar means extending to said work table, said lower end of said annular collar means extending into said liquid;

wherein when said drive shaft rotates said external helical groove means of said pump engages said liquid so as to pump said liquid, in combination with liquid confinement provided by said annular collar means, to said working surface of said grinding bit.

14. The grinding bit apparatus of claim 13, wherein said grinding bit has a first end and a second end, wherein further said grinding bit is symmetrically structured from said first end to said second end so that either said first end thereof or said second end thereof may be placed adjacent said pump, wherein further, said grinding bit has an exterior cylindrical surface which provides a working surface adjacent the work table for grinding of a workpiece, said grinding bit having an axial bit bore which provides removable mounting thereof to the drive shaft adjacent said upper end of said pump; wherein still further, said drive means comprises passive drive mechanism means for passively connecting said grinding bit to the drive shaft, wherein passively connecting is defined as driveably connecting said grinding bit to said drive shaft without use of a fastener.

15. The grinding machine of claim 14, wherein said passive drive mechanism means comprises:

at least a portion of said drive shaft having a non-circular cross-section; and said axial bit bore being reciprocally shaped with respect to said non-circular cross-section of said drive shaft so that said grinding bit is driveably mounted with respect to said non-circular cross-section of said drive shaft.

16. The grinding machine of claim 15, further comprising at least one washer placed between said grinding bit and said pump for repositioning said grinding bit relative to said pump so as to provide a new working surface on said grinding bit adjacent said work table.

17. The grinding machine of claim 13, wherein said work table is provided with an annular recess axially centered with respect to said drive shaft, said annular collar means comprising an outer annular rim which supportably interfaces with said annular recess of said work table, said annular collar means further having bevel means at said upper end thereof for providing an accumulation location for said liquid adjacent said grinding bit.

18. The grinding machine of claim 13, wherein said grinding bit further comprises:

a grinding bit member having a first end and an opposite second end, said grinding bit member having an exterior cylindrical surface for grinding a workpiece; and a mounting member connected with one of said first and second ends of said grinding bit member, said mounting member having an axial mounting bore for providing removable mounting thereof to said drive shaft adjacent said upper end of said pump, said drive means interfacing with said mounting member for transmitting rotation from said drive shaft to said grinding bit member;

further wherein said annular collar means further comprises:

annular extension collar means for providing confinement of said liquid above said work table when said pump is rotated by said drive shaft, said annular extension collar means having a bottom end and a top end, said bottom end of said annular extension collar means connecting with said upper end of said annular collar means; and auxiliary work table member means connected with said top end of said annular extension collar for providing a work table adjacent a working surface of said grinding bit member.

19. The grinding machine of claim 18, wherein said top end of said annular extension collar means further comprises:

inner annular flange means for providing a top end opening of said annular extension collar means which is proximate said grinding bit member;

tab means connected with said inner flange means for causing said liquid pumped by said pump to diverge from said annular extension collar means toward said grinding bit member; and bevel means on said inner annular flange means for providing an accumulation location for said liquid adjacent said grinding bit member.

20. The grinding machine of claim 19, wherein said upper end of said annular collar means is integrally connected with said bottom end of said annular extension collar means.

* * * * *